United States Patent [19]

Odenthal

[11] Patent Number: 5,077,498

[45] Date of Patent: Dec. 31, 1991

[54] PINCHED ELECTRON BEAM CATHODE-RAY TUBE WITH HIGH-VOLTAGE EINZEL FOCUS LENS

[75] Inventor: Conrad J. Odenthal, Portland, Oreg.

[73] Assignee: Tektronix, Inc., Beaverton, Oreg.

[21] Appl. No.: 652,860

[22] Filed: Feb. 11, 1991

[51] Int. Cl.[5] ..... H01J 29/46; H01J 29/56

[52] U.S. Cl. ..... 315/15; 313/414

[58] Field of Search ..... 315/15, 16; 313/414, 313/449

[56] References Cited

U.S. PATENT DOCUMENTS

| | | | |
|---|---|---|---|
| 3,714,504 | 1/1973 | Amboss | 315/15 |
| 3,863,091 | 1/1975 | Hurukawa et al. | 313/452 |
| 3,895,253 | 7/1975 | Schwartz et al. | 313/414 |
| 3,927,341 | 12/1975 | Hughes | 313/417 |
| 4,567,400 | 1/1986 | Opresko | 313/457 |
| 4,582,396 | 4/1986 | Bos et al. | 350/347 E |
| 4,620,134 | 10/1986 | Peels et al. | 315/15 |
| 4,712,043 | 12/1987 | Takenaka et al. | 315/15 |
| 4,977,348 | 12/1990 | Odenthal | 313/479 |
| 4,994,713 | 2/1991 | Chen | 313/414 |

OTHER PUBLICATIONS

Spanjer et al., "A High-Resolution Electron Gun for Color Projection CRTs," SID 87 Digest, 1987, 170–173.

Spanjer et al., "Electron Guns for Projection Television," Phillips Tech. Rev. 44, No. 11/12, 348–356, Nov. 1989.

Clinton Electronics Corp., Rockford, Ill., specification sheets and drawing re Model No. CE869W9P4, Apr. 1988.

*Primary Examiner*—Theodore M. Blum

*Attorney, Agent, or Firm*—John D. Winkelman; Mark M. Meininger

[57] ABSTRACT

A cathode-ray tube (10) includes a prefocusing lens (14) and an adjacent high-voltage einzel focus lens (16) to form an electron beam with low spherical aberration. The high-voltage einzel focus lens includes a central lens element (52) positioned between a pair of outer lens elements (54) and (56). The outer lens elements receive a common high-voltage potential of more than about 12 kilovolts. The prefocusing lens includes a G3 electrode positioned between an anode (48) and a first one of the outer lens elements of the einzel focus lens. The G3 electrode receives the high voltage applied to the outer lens elements. In a preferred embodiment, the G3 electrode is a flat end disc plate (57b) on the end of the first one of the outer lens elements.

16 Claims, 4 Drawing Sheets

PINCHED ELECTRON BEAM CATHODE-RAY TUBE WITH HIGH-VOLTAGE EINZEL FOCUS LENS

TECHNICAL FIELD

The present invention relates to electron discharge tubes and, in particular, to a cathode-ray tube that employs a prefocusing lens in cooperation with a high-voltage einzel focus lens to provide a high-brightness, high-resolution display.

BACKGROUND OF THE INVENTION

High-brightness, high-resolution cathode-ray tubes are employed in a variety of applications including, for example, field sequential liquid crystal color displays of the type described in U.S. Pat. No. 4,582,396 to Bos et al. Such displays typically employ a cathode-ray tube having a single electron gun that generates in sequence three color component images that are transmitted through a liquid crystal light shutter to form a full-color display, These displays are desireable because they are capable of providing high-resolution images in accordance with the resolution of the cathode-ray tube. However, the cathode-ray tube must be capable of forming relatively bright images because the liquid crystal light shutters through which the images are transmitted typically attenuate the brightness of the images by between about 93% and 95%. The cathode-ray tube must, therefore, generate the color component images with a correspondingly increased brightness to provide an acceptable full-color image.

A characteristic of cathode-ray tubes, however, is that increased brightness is provided by an increased electron beam current that typically degrades the display resolution. Specifically, increased electron beam current increases the beam diameter and the space-charge effects among the electrons in the beam, thereby causing the beam to be dispersed and the resolution to be decreased.

U.S. Pat. No. 4,620,134 to Peels et al. discloses a cathode-ray tube having a prefocusing lens and a bipotential main focusing lens positioned in a neck portion of the tube along a central longitudinal axis. The prefocusing lens includes a pair of lens electrodes that are spaced apart such that a factor "S-eff" is less than 1 millimeter, the factor "S-eff" being defined as the minimum of the function:

$$-\Delta V/E(z),$$

in which $\Delta V$ is the difference between the operating voltages of the two prefocusing lens electrodes, and $E(z)$ is the electric field strength between the two lens electrodes along the central longitudinal axis of the tube.

The Peels et al. tube purportedly provides improved spherical aberration characteristics. However, the Peels et al. tube exhibits unacceptably high spherical aberration in applications such as display devices that render very bright, high resolution images of greater than about 1,000 lines on display screens with diagonal dimensions smaller than about 33 cm (13 inches). The Peels et al. tube used in such a small display device exhibits relatively high spherical aberration because of the comparatively large beam currents and the relatively small size of the electron-optical elements in the neck portion of the tube.

Moreover, moderately high voltages of about 7 kilovolts employed in the Peels et al. tube can cause arcing within the tube. Arcing typically draws high currents through the cathode-ray tube and associated circuitry, thereby damaging or destroying the circuitry. Tubes with neck portions of relatively small diameter are especially susceptible to such arcing because of the relatively close spacing of the elements in the tubes.

SUMMARY OF THE INVENTION

An object of the present invention is, therefore, to provide a high-brightness, high-resolution cathode-ray tube.

Another object of this invention is to provide such a tube that has relatively small dimensions and, in particular, a neck portion of relatively small diameter.

A further object of this invention is to provide such a tube having relatively low spherical aberration.

Yet another object of this invention is to provide such a tube with reduced susceptibility to arcing.

The present invention is a relatively small cathode-ray tube capable of providing a high-brightness, high-resolution display that is compatible with, for example, field sequential liquid crystal display systems. In a preferred embodiment, the tube includes a set of two prefocusing lens elements and a high-voltage einzel focus lens that are positioned within a neck portion of an evacuated envelope and cooperate to form an electron beam with low spherical aberration. An electron beam is directed through the prefocusing lens elements and the high-voltage einzel focus lens generally along a central longitudinal axis of the tube.

The high-voltage einzel focus lens provides lower spherical aberration than would a conventional bipotential focus lens. The high-voltage einzel focus lens includes a central lens element or focus ring positioned between a pair of outer lens elements. The outer lens elements receive a common high-voltage potential of more than about 12 kilovolts, and the focus ring receives a potential of between 0 and 6 kilovolts. The electron beam enters and exits the high-voltage einzel focus lens through the outer lens elements designated the input and the output lens elements, respectively.

One of the two prefocusing lens elements is designated an anode. The two prefocusing lens elements are spaced apart such that an electrodynamic function:

$$-\Delta V/E(z),$$

has a minimum value of between 1.0 mm (0.04 inch) and 1.5 mm (0.06 inch). The term $\Delta V$ is the difference between the voltages applied to the two prefocusing lens elements, and the term $E(z)$ is the electric field strength between the two lens elements along the central longitudinal axis.

The evacuated envelope of the tube includes a funnel-portion that extends from the neck portion to a display screen target surface. A magnetic deflection yoke is positioned at the end of the neck portion where it meets the funnel portion. An electrically resistive "DAG" coating is applied to the interior surface of the evacuated envelope aligned with the deflection yoke. The neck portion is preferably of small diameter to increase the efficiency of the deflection yoke.

The tube is manufactured by sliding into the neck portion of the envelope an electron gun assembly that includes a cathode, a brightness control grid, the prefocusing lens elements, and the high-voltage einzel focus lens supported on two or three glass rods. The gun assembly is slid into the neck portion in a direction toward the funnel portion. A pair of resilient, spring-like connectors or snubbers extend from the output lens element of the einzel focus lens and contact the resistive "DAG" coating to electrically couple it to the outer lens elements.

The cathode-ray tube includes various features that reduce the susceptibility of the tube to arcing. For example, a particle trap is secured to the output lens element and extends substantially completely across the neck portion of the envelope to prevent particles of the resistive DAG coating, as well as particles of a phosphor coating on the display screen or particles of a conductive coating on the surface of the funnel portion, from passing into the neck portion of the envelope. Such particles in the neck portion increase the likelihood of arcing by acting as field emission points on lower voltage surfaces positioned adjacent higher voltage surfaces in the tube.

To reduce the flaking of the resistive DAG coating, small patches of a coating with a high electrical conductivity are painted onto the surface of the resistive DAG coating to form contacts for the resilient snubbers of the output lens element. The conductive patches reduce the flaking of the resistive DAG coating by preventing the snubbers from scraping against the resistive coating when the tube is manufactured and by decreasing the electrical resistance between the snubbers and the resistive coating. The decreased resistance reduces the density of the electrical current passing from the resistive coating, through the snubber, to the output lens element. Excessive current densities can cause flaking of the resistive coating.

It will be appreciated that the likelihood of arcing is greatly increased by the presence of field emission points (e.g., contaminants or rough surfaces) at areas within the tube where high voltage and low voltage surfaces are positioned close together. For example, there are several areas within the tube where electrically conductive surfaces (e.g., the focus ring and the anode) that receive relatively low voltages are positioned immediately adjacent electrically insulating surfaces (e.g., the glass support rods or the interior surface of the neck portion of the tube). In addition, the anode is supported on legs that are inserted into the glass support rods. The reason that these areas are so susceptible to arcing is that the insulating surfaces tend to charge up to the high voltages (e.g., equal to or greater than 12 kilovolts) within the tube.

To reduce the likelihood of this charging and the subsequent arcing, therefore, several insulating surfaces within the tube are either shielded with electrically conductive electrodes or are coated with an electrically conductive material. For example, an electrically conductive arc suppression ring is aligned with the end of the input lens element of the high-voltage einzel focus lens to shield the glass support rods and reduce the electric field gradients along them. In addition, an electrically conductive coating is applied to the outer surfaces of the glass support rods in alignment with the focus lens element and the arc suppression ring.

The arc suppression ring and the electrically conductive coatings help provide for substantially uniform charge distributions in areas susceptible to forming high intensity electric fields. As a result, field emission points on adjacent low voltage, electrically conductive surfaces are shielded from the high intensity fields, thereby decreasing the likelihood of arcing within the tube.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figure 1:
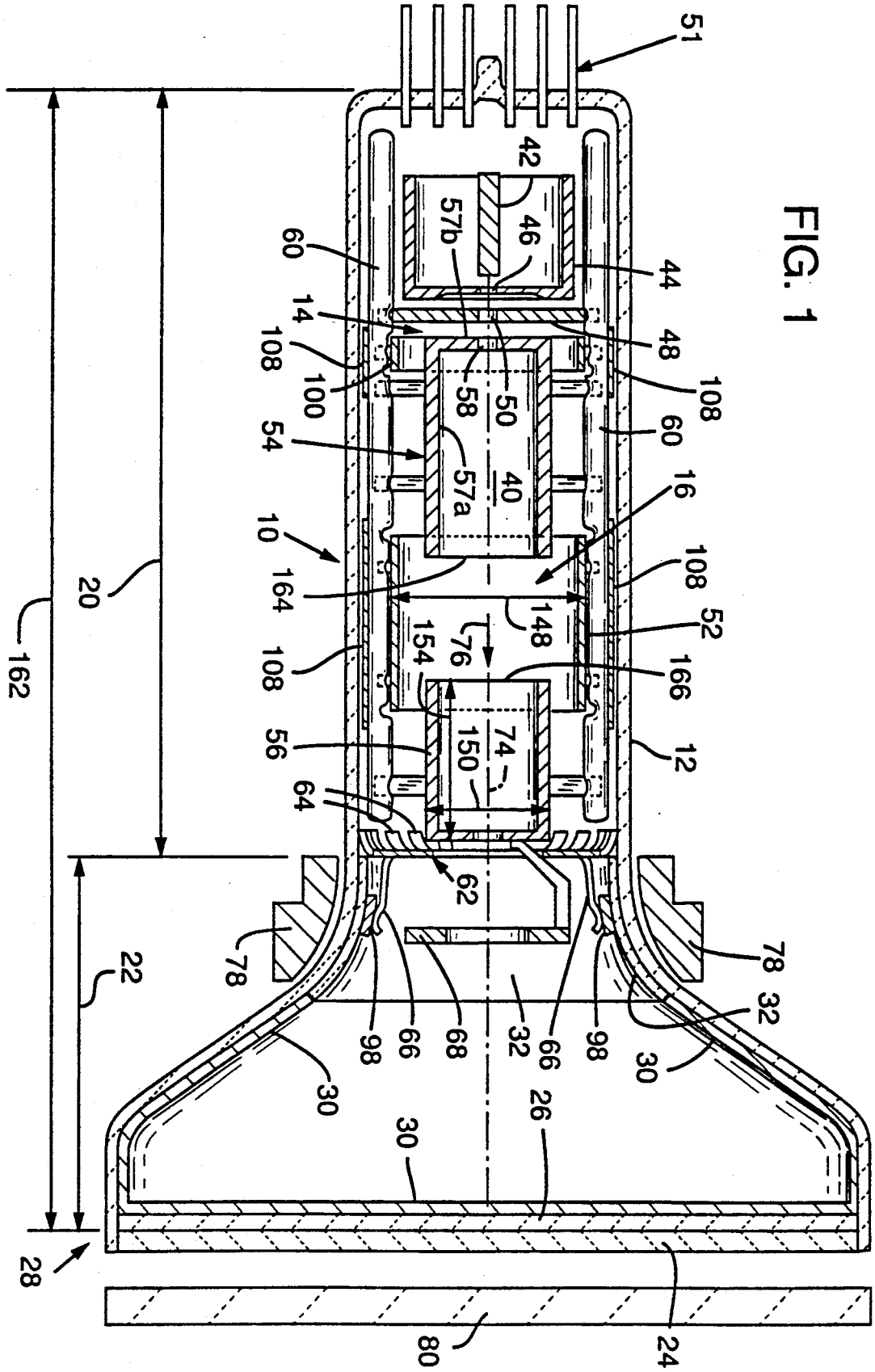
FIG. 1 is a longitudinal, side elevation sectional view of a cathode-ray tube incorporating the features of the present invention.

FIG. 1 shows a high-brightness, high-resolution cathode-ray tube 10 having an evacuated envelope 12 that contains a prefocus lens 14 and a high-voltage einzel focus lens 16 that cooperate to form an electron beam with low spherical aberration. Envelope 12 includes a tubular glass neck 20, a glass funnel 22 and an optically transparent glass faceplate 24. A layer 26 of phosphor material is deposited on the inner surface of faceplate 24 to form the display screen 28 of cathode-ray tube 10. An electron-transparent aluminum film 30 is deposited by evaporation on the inner surface of funnel 22 and phosphor layer 26, and a portion of the inner surface of envelope 12 is coated with an electrically resistive DAG layer 32.

An electron gun 40 is positioned in glass neck 20 at the end of tube 10 opposite display screen 28. Gun 40 includes a cathode 42 that receives a potential of between 0 and +60 volts, a cup-shaped control grid or G1 44 that receives a potential near 0 volts and has an aperture 46, and an anode wafer or G2 48 that has an aperture 50. Anode 48 receives a potential of between 150 and 250 volts, preferably about +200 volts relative to the potential on control grid 44. The range of potentials applied to anode 48 establishes for cathode 42 a relatively low cathode cut-off voltage of +60 volts. Voltages are applied to cathode 42, control grid 44, and anode 48 via a set of base pins 51 and connecting wires (not shown).

A benefit of the low cathode cut-off voltage is that it allows cathode 42 to be driven by a video drive signal of correspondingly low magnitude. Video drive signals of low magnitude are desirable in, for example, field sequential liquid crystal display systems. The field sequential operation of such systems typically require video drive signal frequencies that are up to three times greater than the frequencies of conventional video drive signals. Circuitry for generating such high frequency video drive signals can be expensive if conventional signal magnitudes are employed.

High-voltage einzel focus lens 16 is a three-element einzel lens that includes a central tubular element or focus ring 52 positioned between a pair of spaced apart outer tubular elements 54 and 56. Outer tubular element 54 includes a cylindrical portion 57*a* and a flat end disc plate 57*b* (also referred to as G3) that has an aperture 58 positioned adjacent aperture 50. Outer tubular element 54 may be formed by stamping a single outer electrode blank with a set of dies or by welding or soldering end disc plate 57*b* to cylindrical portion 57*a*.

Focus ring 52 receives via one of base pins 51 a potential of between 0 and 6 kilovolts, preferably about +4.2 kilovolts, as a center screen focus potential. Focus potentials of greater than 6 kilovolts applied to base pins 51 can cause arcing in conventional base pin assemblies. Outer tubular elements 54 and 56 receive a high-voltage potential of between 12 and 24 kilovolts, preferably about 18 kilovolts, as described below. The high-voltage nature of einzel focus lens 16 relates, therefore, to the high-voltage potentials applied to outer tubular elements 54 and 56. Such high voltages would be incompatible with a conventional bipotential focus lens.

The low cathode cut-off video voltage is compatible with the high-resolution performance of cathode-ray tube 10 because of the cooperation between the high voltage applied to tubular element 54 and the low voltage applied to anode 48. Specifically, the low voltage applied to anode 48 allows the cathode cut-off video voltage to be low, whereas the high voltage on tubular element 54 cooperates with the low voltage on anode 48 together with the size of aperture 50 to strongly prefocus the electron beam to provide the high resolution. As described below in greater detail, aperture 50 has a relatively small diameter, thereby increasing the strength of prefocus lens 14.

Moreover, the low cathode cut-off video voltage allows cathode 42 to operate with relatively low cathode loading (i.e., the current density of the electron beam emanating from the cathode). The low cathode loading is beneficial because it increases the operating life of cathode 42 and, therefore, tube 10. It will be appreciated, however, that the low cathode cut-off video voltage and low cathode loading provided by the present invention are advantageously contrary to conventional cathode-ray tube designs. Typically, higher magnitude cathode cut-off video voltages, higher video drive voltages, and higher cathode loading are used to obtain higher resolution.

Electron gun 40 and high-voltage einzel focus lens 16 are supported between a pair of glass rods 60 that extend along neck portion 20 of envelope 12. A particle trap 62 is secured to the end of outer tubular element 56. Particle trap 62 includes multiple flexible fingers 64 that are positioned about its periphery and engage the interior surface of the neck portion 20. Tubular element 56 also includes a pair of electrically conductive, resilient, spring-like fingers or snubbers 66 that press against and contact the interior surface of envelope 12 coated with resistive DAG layer 32. A getter ring 68 is also attached to the end of tubular element 56 and is used to deposit a layer of getter material on the interior surfaces of envelope 12 to facilitate the evacuation of it during manufacturing. Electron gun 40 produces a beam of electrons that propagate generally along a central longitudinal axis 74 in a direction 76 toward display screen 28. Control grid 44, apertures 46 and 50 and tubular elements 52, 54, and 56 are axially aligned with central longitudinal axis 74.

Anode 48 with aperture 50 and disc plate 57*b* with aperture 58 cooperate to function as prefocusing lens 14. In operation, the comparatively low +200 volt potential applied to anode 48 causes the electron beam to propagate from aperture 46 to aperture 50 at a relatively low speed. Anode 48 and aperture 50 function, therefore, as a relatively strong first prefocusing lens element for converging the outer rays of the electron beam while diverging the inner rays of the beam. In addition, the high voltage received by disc plate 57*b* of outer tubular element 54 provide prefocus lens 14 with improved spherical aberration characteristics.

A magnetic deflection yoke 78 is positioned at the end of funnel portion 22 where it meets neck portion 20 for scanning the electron beam across the display screen 28 in a conventional raster-scan pattern. Deflection yoke 78 includes horizontal and vertical deflection coils (not shown) that deflect the electron beam in horizontal and vertical directions, respectively. Deflection yoke 78 overlaps the portion of envelope 12 coated with resistive DAG layer 32. A liquid crystal light shutter 80 is positioned in front of display screen 28 (shown spaced apart for purposes of clarity) and cooperates with tube 10 to function as a field sequential liquid crystal color display apparatus 82.

Display apparatus 82 may be formed with a display screen 28 having a diagonal measurement of between about 10 cm (4 inches) and 69 cm (27 inches). Preferably, display screen 28 of tube 10 has a diagonal measurement of about 25.4 cm (10 inches) to be incorporated in, for example, a small sized personal computer. To be compatible with such a display screen 28, neck portion 20 of envelope 12 has a relatively small outer diameter of about 20 mm (0.79 inch).

Figure 3:
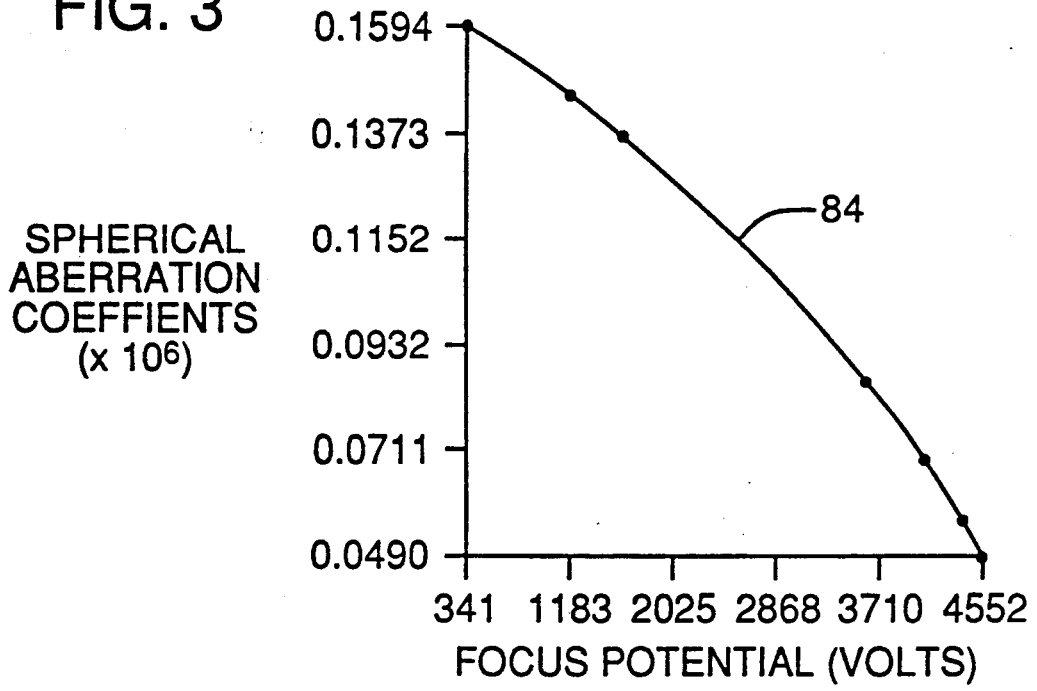
FIG. 3 is a graph of the spherical aberration coefficient of a focused electron beam in the tube of FIG. 1, as a function of the focus voltage magnitude.

The high-resolution capability of cathode-ray tube 10 requires that einzel focus lens 16 in electron gun 40 form an electron beam with low spherical aberration. FIG. 3 shows a curve 84 of the spherical aberration coefficient of the electron beam generated in tube 10, as a function of the focus voltage applied to central tubular element 52. It will be appreciated that the focus voltage is related to the distance between tubular elements 54 and 56, as described below in greater detail. Moreover, the magnitude of the focus voltage is related to that of the high-voltage potential applied to, and the spacing between, outer electrodes 54 and 56. Accordingly, FIG. 3 shows that the characteristics of einzel focus lens 16 are important for reducing the spherical aberration in the electron beam.

Figure 4:
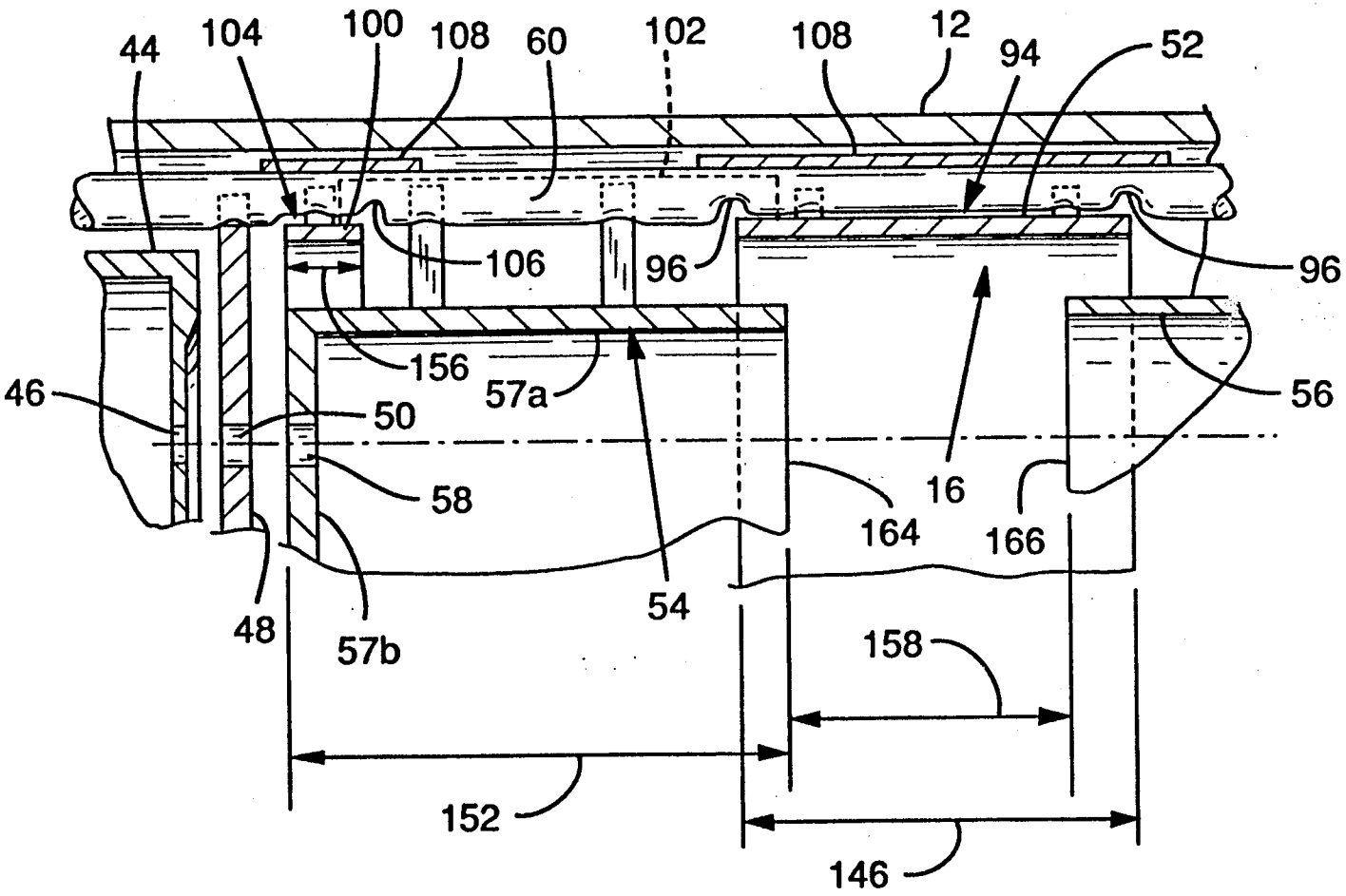
FIG. 4 is an enlarged fragmentary side elevation view of a high-voltage einzel focus lens and an anode secured to a glass rod.

FIG. 4 is an enlarged fragmentary side elevation sectional view showing high-voltage einzel focus lens 16 secured to one of glass rods 60. The configuration of glass rod 60 is substantially the same for both the glass rods in cathode-ray tube 10.

With reference to FIG. 4, focus element 52 is set within a recess 94 in glass rod 60 to allow element 52 to be formed with the largest possible diameter. The large diameter of focus element 52 functions to reduce the spherical aberration coefficient of the einzel focus lens despite the small diameter of neck portion 20. Recess 94 includes a gap 96 at each end of focus ring 52 to provide adequate separation between glass rods 60 and the ends of ring 52.

The separation provided by gaps 96 reduces the field emission leakage of electrons from focus ring 52 to glass rods 60. Such field emission leakage can cause arcing, as described in greater detail below. In addition, recess 94 allows focus ring 52 to have a large diameter that increases the separation between focus ring 52 and outer electrodes 54 and 56, thereby further reducing the incidence of arcing.

The high voltages applied to outer elements 54 and 56 of einzel focus lens 16 could cause arcing to occur within cathode-ray tube 10. Moreover, the relatively small diameter of neck portion 20 can further increase the susceptibility to arcing because of the corresponding small distances separating the electrode elements. Accordingly, cathode-ray tube 10 includes various features that offset the increased likelihood of arcing.

Specifically, particle trap 62 prevents particles that flake off of, for example, resistive DAG coating 32, aluminum film 30, or phosphor layer 26, from propagating along neck portion 20. The particles may be knocked loose during the manufacture of the tube when electron gun 40 is slid into glass envelope 12, during a manufacturing process step called "spot knocking" in which very high-voltage arcs are purposely generated within the tube to eliminate contaminants, or simply during handling of the tube.

Such particles increase the likelihood of arcing by acting as field emission points on lower voltage surfaces that are positioned adjacent higher voltage surfaces in tube 10. For example, focus ring 52 is an electrically conductive surface that receives a relatively low voltage of about 4.2 kilovolts, and glass support rods 60 are adjacent electrically insulating surfaces that tend to charge up to the highest voltage within tube 10 (i.e., the 18 kilovolts applied to elements 54 and 56).

Snubbers 66 on outer element 56 each engage a patch 98 of a coating with high electrical conductivity painted onto the surface of resistive layer 32. Patches 98 are relatively small rectangular areas of between 0.4 $cm^2$ (0.062 $in^2$) and 0.6 $cm^2$ (0.043 $in^2$), preferably about 0.5 $cm^2$ (0.078 $in^2$). Patches 98 are formed of silver paint in a manner known in the art with their longer sides being substantially parallel to axis 74. Patches 98 reduce the incidence of arcing by preventing snubbers 66 from scraping particles of the resistive DAG away from resistive coating 32 when gun 40 and einzel lens 16 on glass rods 60 are slid into glass envelope 12.

Patches 98 further reduce the incidence of arcing by distributing the electrical coupling between snubbers 66 and resistive layer 32 over a larger area. The distributed electrical coupling decreases the electrical resistance and, therefore, enables the passage of high density electrical currents between snubbers 66 and resistive layer 32 during the spot knocking manufacturing process. As a result, patches 98 reduce the number of particles generated during spot knocking.

The relatively small areas of patches 98 inhibit the generation of eddy currents thereon by deflection yoke 78. Eddy currents are a common characteristic on conductive surfaces overlapped by a magnetic deflection yoke. Eddy currents are, however, undesirable because they dissipate the energy in the beam deflection fields, thereby reducing the efficiency of the deflection yoke.

Moreover, the additional energy generates in neck 20 and funnel 22 heat that increases the mobility of ions therein such that the high voltage on coating 32 or patches 98 can "punch through" to yoke 78. Punch through is a severe type of arc that typically shatters envelope 12, thereby destroying tube 10 and its associated circuitry.

With reference to FIGS. 1 and 4, an arc suppression ring 100 radially overlaps and has an end aligned with the end of outer tubular element 54 positioned adjacent anode 48. Arc suppression ring 100 is electrically connected to focus ring 52 by a wire 102 (shown as a broken line) and shields outer tubular element 54 from field emission locations on anode 48 and control grid 44. Arc suppression ring 100 is of substantially the same diameter as focus ring 52 and is set within a recess 104 with a gap 106 in glass rods 60. Arc suppression ring 100 functions to provide a uniformly charged surface in opposition to the end of outer tubular element 54. Such a uniform charge distribution functions to suppress the generation of arcs from anode 48 to the end of element 54 by reducing the charge potential on glass rods 60.

Glass rods 60 have outer sides that are in face-to-face relation to the interior surface of envelope 12. Electrically conductive paint coatings 108 are applied to the outer sides of glass rods 60 in alignment with focus ring 52 and ar suppression ring 100. Conductive coatings 108 function to suppress arcing by providing substantially uniform charge distribution along glass rods 60 and the interior surface of envelope 12. Accordingly, conductive coatings 108, arc suppression ring 100, conductive patches 98, and particle trap 62 all sufficiently suppress arcing to allow high-voltage einzel focus lens 16 and display screen 28 to operate at a high voltage despite the small diameter of neck portion 20.

Figure 2:
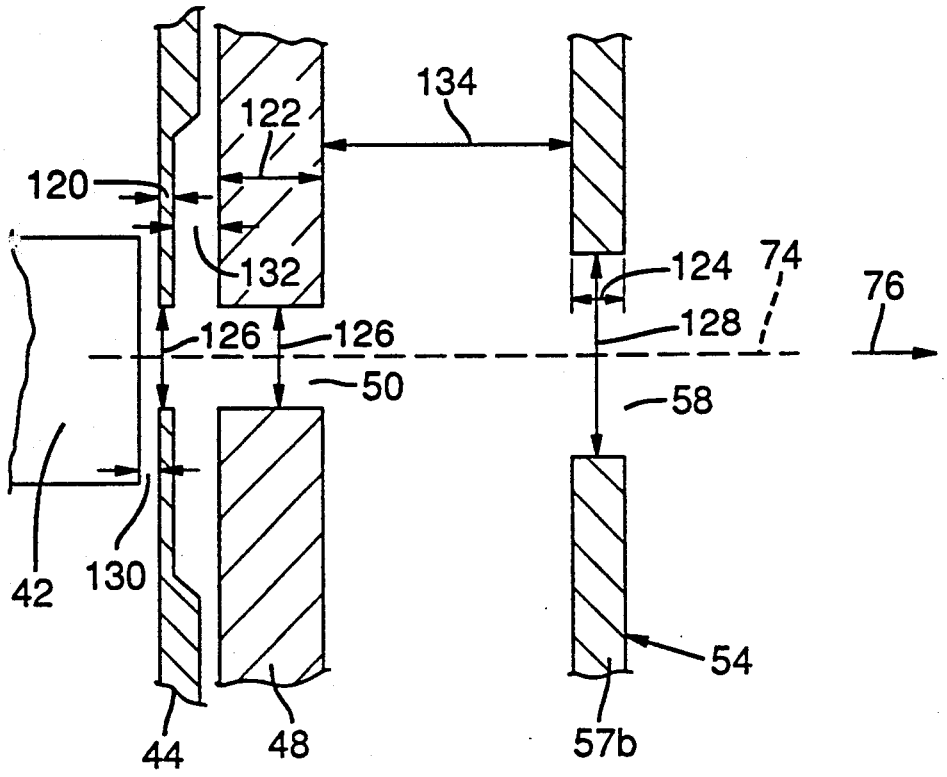
FIG. 2 is an enlarged, fragmentary side elevation view of a prefocusing lens in the tube of FIG. 1.

FIGS. 1 and 2 show the dimensions of various elements in cathode-ray tube 10. Specifically, control grid 44 has a stamped or "coined" thickness 120 of about 0.076 mm (0.003 inch), anode 48 is preferably a wafer that has a thickness 122 of about 0.50 mm (0.020 inch), and G3 aperture 58 has a length 124 of about 0.25 mm (0.010 inch). G1 aperture 46 and G2 aperture 50 have diameters 126 of about 0.56 mm (0.022 inch) and aperture G3 has a diameter 128 of about 1 mm (0.40 inch).

Control grid 44 is spaced apart from cathode 42 by a distance 130 of about 0.10 mm (0.004 inch). Anode 48 is spaced part from aperture 46 in control grid 44 by a distance 132 of about 0.23 mm (0.009 inch). Outer tubular element 54 is spaced apart from anode 48 by distance 134 of about 1.27 mm (0.050 inch).

Figure 5:
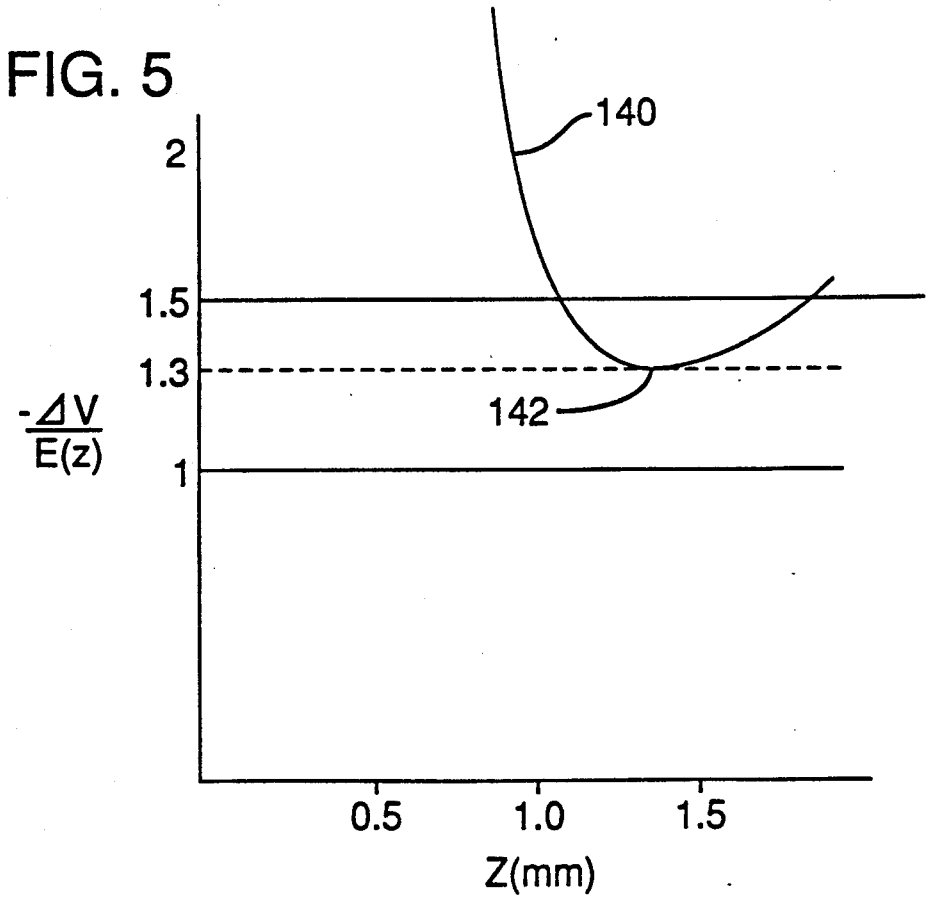
FIG. 5 is a graph of an electrodynamic function relating to the prefocusing lens elements in the tube of FIG. 1.

Distance 134 between anode 48 and disc plate **57*b*** is selected such than an electrodynamic function:

$$-\Delta V/E(z)$$

has a minimum value of between 1.0 mm and 1.5 mm. The term $\Delta V$ is the difference between the voltages applied to anode 48 and tubular element 54, and the term E(z) is the electric field strength between these elements along central longitudinal axis 74. FIG. 5 is a graph showing a curve 140 of the function and its minimum 142 for cathode-ray tube 10.

With reference to FIGS. 1 and 4, focus ring 52 has a length 146 and an outer diameter 148 of 17.0 mm (0.670 inch) and 12.1 mm (0.475 inch), respectively. Outer tubular elements 54 and 56 each have an outer diameter of 150 of about 8.0 mm (0.315 inch) and respective lengths 152 and 154 of 15.5 mm (0.612 inch) and 9.4 mm (0.370 inch). Elements 54 and 56 are spaced apart by a distance 158 of 14.0 mm (0.550 inch). Arc suppression ring 100 has a length 156 of 5.08 mm (0.20 inch). Cathode-ray tube 10 has an overall length 160 of 235 cm (9.25 inches). It will be appreciated that, for a given diameter of its tubular elements, einzel lens 16 provides lower spherical aberration than would a conventional bipotential focus lens.

Figure 6:
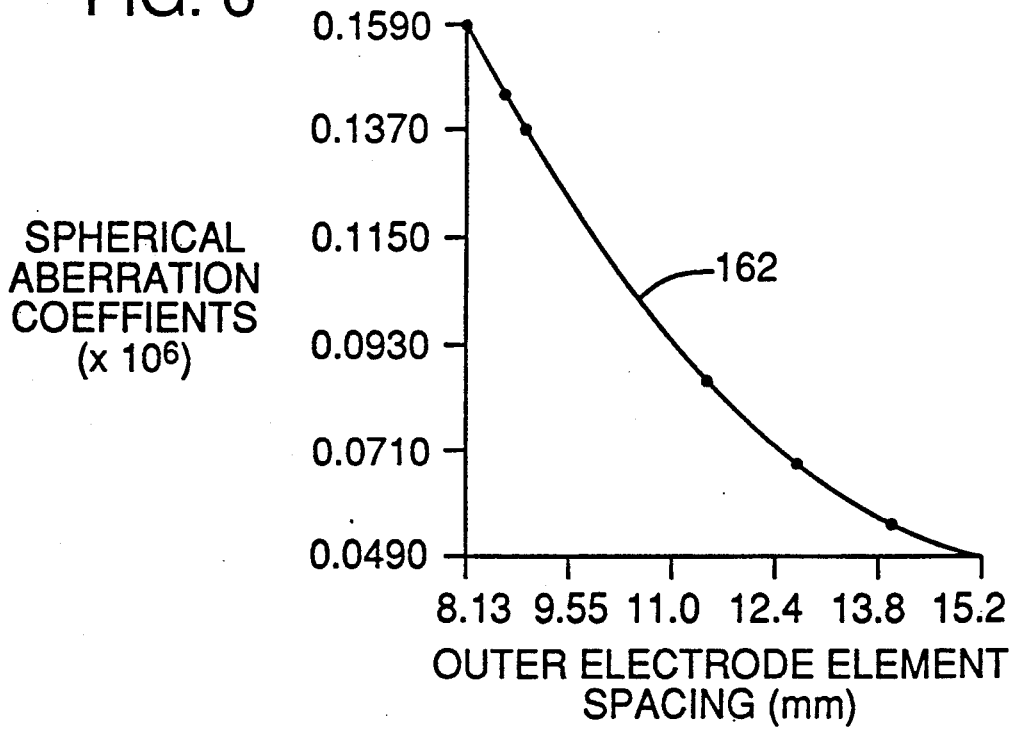
FIG. 6 of a graph of the spherical aberration coefficient of a focused electron beam in the tube of FIG. 1, as a function of the spacing between the outer electrode elements of the einzel focus lens.

FIG. 6 shows a curve 162 of the spherical aberration coefficient of the electron beam generated in tube 10, as a function of spacing 158 between outer electrodes 54 and 56. Curve 162 shows that the spherical aberration is reduced as spacing 158 between outer electrodes 54 and 56 is increased. Therefore, increasing spacing 158 causes the focus voltage applied to focus ring 52 to further minimize the electron beam spot size and increase resolution of tube 10.

With reference to FIGS. 3 and 6, curve 162 has a decreasing slope, which indicates that increasing distance 158 between outer electrodes 54 and 56 beyond 15.2 mm (0.600 inch) provides relatively small reductions in the spherical aberration coefficient, thereby causing gun 40 to become excessively long for small reductions in the spherical aberration coefficient. Since the focus voltage and distance are related to each other, the preferred distance 158 of 14.0 mm (0.550 inch) and establishes a focus voltage of 4.2 kilovolts. These operating conditions provide an improvement of about 300% in the spherical aberration coefficient for tube 10, as compared to the lowest voltage, closest spacing arrangements shown in curves 84 and 162.

Moreover, outer electrodes 54 and 56 are open-ended at their opposed inner faces 164 and 166, respectively. Open-ended inner faces 164 and 166 on respective electrodes 54 and 56 form large diameter openings that also function to reduce the spherical aberration coefficient of einzel focus lens 16.

It will be obvious to those having skill in the art that many changes may be made in the above-described details of the preferred embodiment of the present invention without departing from the underlying principles thereof. The scope of the present invention should, therefore, be determined only by the following claims.

I claim:

1. In an electron discharge tube having within an evacuated envelope a cathode that directs an electron beam generally along a beam axis toward a target surface, the improvement comprising:

a prefocusing lens positioned adjacent the cathode and having successive first and second electrodes that receive respective first and second potentials, the second potential having a magnitude greater than about 12 kilovolts;

a high-voltage einzel focus lens positioned to receive the electron beam from the prefocusing lens and to focus the electron beam toward the target surface, the einzel focus lens including first and second outer lens elements that receive a common high-voltage potential and have positioned between them a central lens element that receives a lower-voltage focus potential, the first and second outer lens elements having opposed open-ended faces and the first outer lens element having an outer diameter and a flat end disc plate with an aperture axially aligned with the beam axis, the end disc plate being positioned adjacent the first electrode of the prefocusing lens and functioning as the second electrode of the prefocusing lens; and an annular ring that radially overlaps the flat end disc plate and has an inner diameter that is greater than the outer diameter of the first outer lens element.

2. The tube of claim 1 in which the high-voltage potential received by the first and second outer lens elements of the einzel focus lens is substantially the same as the second potential received by the second electrode of the prefocusing lens.

3. The tube of claim 1 in which the annular ring receives a potential of a magnitude substantially equal to that of the focus potential received by the central lens element of the einzel focus lens.

4. The tube of claim 1 in which the high-voltage potential applied to the outer lens elements has a magnitude of between 12 kilovolts and 24 kilovolts.

5. The tube of claim 1 in which the einzel focus lens includes a three-element einzel lens.

6. The tube of claim 1 further comprising a particle trap positioned between the einzel focus lens and the target surface, the particle trap extending substantially completely across the interior of the evacuated envelope.

7. The tube of claim 1 further comprising an electromagnetic deflection yoke positioned outside the evacuated envelope to deflect the electron beam focused toward the target surface by the einzel focus lens, an electrically resistive coating on the interior surface of the evacuated envelope in alignment with the electromagnetic deflection yoke, and a patch of an electrically conductive coating on the electrically resistive coating, the second outer lens element of the einzel focus lens being positioned between the central lens element and the target surface and including a resilient finger that contacts the patch, thereby to electrically connect the second outer lens element and the electrically resistive coating.

8. The tube of claim 1 further comprising at least two electrically insulating rods that support between them and along their lengths the prefocusing lens and the einzel focus lens, each of the rods having a first length segment aligned with the central lens element of the einzel focus lens, an outer surface in face-to-face relation with the interior surface of the evacuated envelope, and an electrically conductive coating on the outer surface of the first length segment.

9. The tube of claim 1 further comprising at least two electrically insulating rods that support between them and along their lengths the einzel focus lens, each of the rods having a first length segment aligned with the central lens element of the einzel focus lens, an inner surface in face-to-face relation to the einzel focus lens, and a recess within the rod along the first length segment of its inner surface to receive the central lens element.

10. In a field sequential liquid crystal color display, a high resolution electron discharge tube, comprising:

cathode means for generating only one electron beam that propagates generally along a beam axis within the tube toward a target surface;

a prefocusing lens positioned adjacent the cathode means and having successive first and second electrodes that receive, respectively, a first potential of between about 150 and 250 volts and a second potential greater than about 12 kilovolts; and a high-voltage einzel focus lens positioned to receive the electron beam from the prefocusing lens and to focus the electron beam toward the target surface, the einzel focus lens including first and second outer lens elements that receive a common high-voltage potential and have positioned between them a central lens element that receives a lower-voltage focus potential, the first and second outer lens elements having opposed open-ended faces.

11. The tube of claim 10 in which the high-voltage potential received by the first and second outer lens elements of the einzel focus lens is substantially the same as the second potential received by the second electrode of the prefocusing lens.

12. The tube of claim 10 in which the first outer lens element of the einzel focus lens includes a flat end plate with an aperture axially aligned with the beam axis, the end plate being positioned adjacent the first electrode of the prefocusing lens and functioning as the second electrode of the prefocusing lens.

13. The tube of claim 10 in which the einzel focus lens includes a three-element einzel lens.

14. The tube of claim 10 in which the high-voltage potential applied to the first and second outer lens elements has a magnitude of between 12 kilovolts and 24 kilovolts.

15. The tube of claim 10 in which the first outer lens element of the einzel focus lens has an outer diameter, the tube further comprising an annular ring that radially overlaps the first outer lens element and has an inner diameter that is greater than the outer diameter of the first outer lens element.

16. The tube of claim 15 in which the annular ring receives a potential of a magnitude substantially equal to that of the focus potential received by the central lens element of the einzel focus lens.

* * * * *